US009661416B2

(12) United States Patent
Kirsch

(10) Patent No.: US 9,661,416 B2
(45) Date of Patent: May 23, 2017

(54) TECHNIQUES FOR OPTIMIZING THE POLARITIES OF AUDIO INPUT CHANNELS

(71) Applicant: Harman International Industries, Incorporated, Stramford, CT (US)

(72) Inventor: James M. Kirsch, Salt Lake City, UT (US)

(73) Assignee: HARMAN INTERNATIONAL INDUSTRIES, INC., Stamford, CA (US)

( * ) Notice: Subject to any disclaimer, the term of this patent is extended or adjusted under 35 U.S.C. 154(b) by 0 days.

(21) Appl. No.: 14/834,427

(22) Filed: Aug. 24, 2015

(65) Prior Publication Data

US 2017/0064442 A1 Mar. 2, 2017

(51) Int. Cl.
*H04R 29/00* (2006.01)
*H04R 3/00* (2006.01)

(52) U.S. Cl.
CPC ..... *H04R 3/00* (2013.01); *H04R 3/005* (2013.01); *H04R 29/001* (2013.01); *H04R 2420/01* (2013.01); *H04S 2400/15* (2013.01)

(58) Field of Classification Search
CPC ..... G10K 11/1784; G10K 2210/108; G10K 11/178; G10K 2210/3028; G10K 2210/3055; G10K 11/175; G10K 2210/30231; G10K 2210/3056; G10K 2210/3039; G10K 2210/3026; G10K 2210/3035; G10K 2210/3014; G10K 11/1786; G10K 2210/3011;
(Continued)

(56) References Cited

U.S. PATENT DOCUMENTS 6,594,601 B1 * 7/2003 Umminger, III ..... G10H 1/08 369/4
2008/0288094 A1 * 11/2008 Fukushima ..... G10L 21/038 700/94

(Continued)

OTHER PUBLICATIONS

Extended European Search Report Application No. 16185093.8, dated Jan. 27, 2017, 6 pages.

*Primary Examiner* — Paul S Kim
*Assistant Examiner* — Norman Yu
(74) *Attorney, Agent, or Firm* — Artegis Law Group, LLP

(57) ABSTRACT

In one embodiment, a polarity optimizer determines optimal polarities of audio input channels. In operation, the polarity optimizer generates multiple polarity combinations, where each polarity combination specifies a different combination of polarities of the audio input channels. For each of these polarity combinations, the polarity optimizer combines inverted and/or non-inverted samples of the audio input channels to generate a corresponding audio mix. For each of the audio mixes, the polarity optimizer calculates the value of a pre-determined signal characteristic. The polarity optimizer then compares these values and sets the optimized polarities in accordance with the polarity combination corresponding to the audio mix with the optimal value. Because the polarity optimizer operates in a concurrent and deterministic fashion on candidate audio mixes, the polarity optimizer enables the production of an optimized listening experience without exposing the audience to multiple, inferior, "trial-and-error" audio mixes during the optimization process.

14 Claims, 5 Drawing Sheets

(58) Field of Classification Search
CPC . G10K 2210/30232; G10K 2210/3025; G10K 2210/3213; H04R 1/1083; H04R 2499/13; H04R 3/04; H04R 2499/11; H04R 3/005; H04R 5/04; H04R 1/288; H04R 3/00; H04R 1/403; H04R 2205/022; H04R 2205/024; H04R 5/02; H04R 2410/03; H04R 2420/01; H04R 2420/03; H04R 3/12; H04S 1/002; H04S 3/002; H04S 2400/15; H04S 5/00; H04S 3/00; H04S 7/30; H04S 2420/01; G10L 19/02; G10L 2021/02165; G10L 19/008; G10L 25/09; G10L 25/21; H03F 2200/03; H03F 3/187; H03F 3/68
USPC ..... 381/71.11, 71.1, 61, 120, 17, 56, 59, 381/71.8, 101, 104, 107, 119, 123, 307, 381/58, 74, 77, 80, 94.9, 97; 700/94
See application file for complete search history.

(56) References Cited

U.S. PATENT DOCUMENTS

| | | | | |
|---|---|---|---|---|
| 2011/0081024 | A1 | 4/2011 | Soulodre | |
| 2014/0016783 | A1* | 1/2014 | Horbach | H04S 7/301 381/1 |
| 2014/0363009 | A1 | 12/2014 | Trammell | |
| 2015/0063573 | A1 | 3/2015 | Daly | |

* cited by examiner

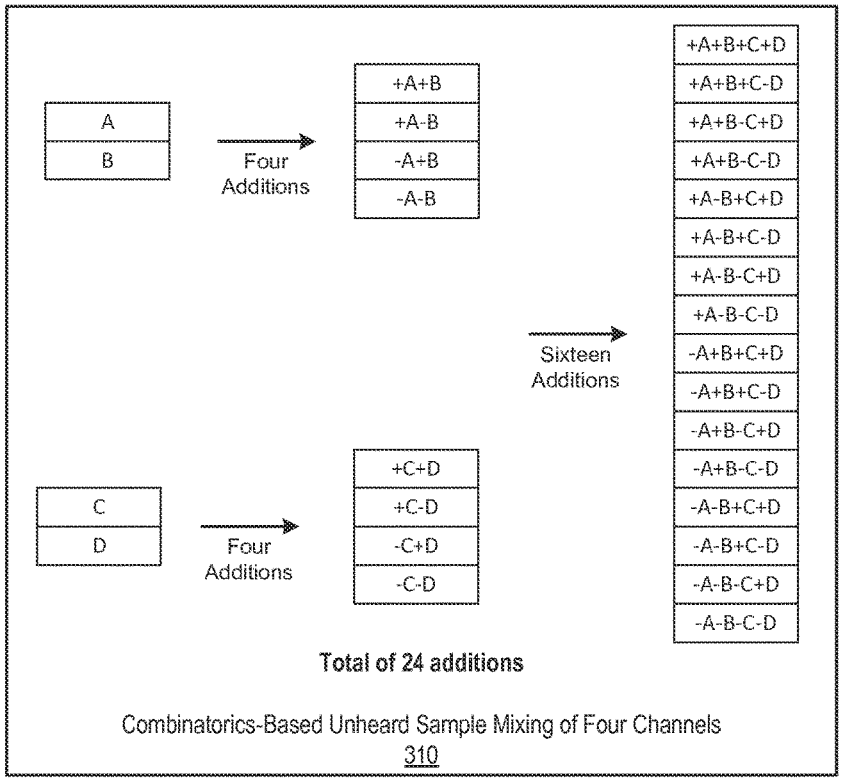

Combining A with B, C with D, E with F, G with H, I with J, K with L, M with N, O with P:
4 additions for each pair = 8 * 4 = 32 additions
+
Combining AB combos with CD combos, EF combos with GH combos,
IJ combos with KL combos, and MN combos with OP combos:
16 additions for each combo = 4 * 16 = 64 additions
+
Combining ABCD combos with EFGH combos and IJKL combos with MNOP combos:
256 additions for each combo = 2 * 256 = 512 additions
+
Combining ABCDEFGH combos with IJKLMNOP combos:
65536 additions
=
Total of 66144 additions

Combinatorics-Based Unheard Sample Mixing of Sixteen Channels
350

FIGURE 3

TECHNIQUES FOR OPTIMIZING THE POLARITIES OF AUDIO INPUT CHANNELS

BACKGROUND

Field of the Various Embodiments

The various embodiments relate generally to acoustics technology and, more specifically, to techniques for optimizing the polarities of audio input channels.

Description of the Related Art

Oftentimes, separate audio signals, known as "channels," are combined to create a cohesive audio mix—one or more composite signals that produce a desired listening experience for the audience. Various techniques and equipment (e.g., mixing consoles, digital audio workstations, etc.) enable mixing engineers to efficiently create customized audio mixes. For example, a mixing engineer may use a mixing console to dynamically design an audio mix of a performance in real-time (i.e., as the performance occurs) based on audio input channels received by the mixing console. In general, as part of designing the audio mix, the mixing engineer may configure the mixing console to perform one or more compensation operations, such as gain, polarity inversion, stereo panning, equalization, and the like. Each of these compensation operations modifies the contributions of one or more of the audio input channels to the audio mix in an attempt to generate a particular listening experience for the audience.

In particular, because audio input channels may combine destructively or constructively, inverting the polarity of one audio input channel (i.e., flipping the phase of the audio input channel by 180 degrees) relative to another audio input channel may significantly impact the listening experience for the audience. As is well-known, when two audio input channels combine destructively, the contributions of each of the two audio input channels to the audio mix are attenuated. Such attenuation is often perceived by listeners as "thin" sound and is particularly noticeable at relatively lower frequencies (i.e., bass frequencies). To avoid such sound degradation and improve the listening experience for the audience, many mixing engineers use a trial-and-error approach in determining whether to invert the polarity of each of the audio input channels.

With trial-and-error, the mixing engineer typically first sets the polarities of the audio input channels to an "A" set of values. The mixing engineer then auditions the "A" audio mix—subjectively assessing the quality of the "A" listening experience. Next, the mixing engineer sets the polarities of the audio input channels to a "B" set of values, usually by flipping the polarity of just one channel. The mixing engineer then auditions the "B" audio mix and compares the quality of the "B" listening experience to the quality of the "A" listening experience. If the mixing engineer believes that the "A" listening experience is superior, then the mixing engineer restores the polarities of the audio input channels to the "A" set of values. The mixing engineer continues in this same manner throughout the performance, "AB-ing" the polarities of different audio input channels in a more or less ad-hoc basis.

One problem with the above approach is that listeners are unnecessarily exposed to sound variations, especially periods of weak bass, throughout the performance. More specifically, each time the mixing engineer auditions new polarities of the audio input channels, the listeners also—undesirably—"audition" the new polarities of the audio input channels. For example, if the mixing engineer auditions a combination of polarities of the audio input channels that cause the contributions of each of two bass guitars to combine destructively, then the audience would be exposed to a thin-sounding listening experience with little or no contribution from the bass guitars for the duration of the audition.

Further, because the number of combinations for the polarities of N audio input channels is 2^(N−1) (e.g., for 32 audio input channels, there are 2,147,483,648 possible polarity combinations), a comprehensive trial-and-error approach is prohibitively time-consuming and tedious for most performances. Notably, the auditioning may take several seconds to listen to, thereby limiting the effectiveness of this style of audio mixing irrespective of whether the mixing engineer is performing the mixing operations live or off-line (i.e., in an audio studio) without an audience. Finally, because comparing the "A" and "B" listening experiences is necessarily subjective and dependent on the skill of the mixing engineer, the selected polarities of the audio input channels for the ultimate audio mix may be suboptimal.

As the foregoing illustrates, more effective techniques for optimizing the polarities of audio input channels would be useful.

SUMMARY

One embodiment sets forth a method for selecting the polarities for multiple audio input channels when generating an audio mix. The method includes generating multiple polarity combinations, where each polarity combination is associated with each polarity-sensitive audio input channel included in the multiple audio input channels; for each polarity combination included in the multiple polarity combinations: performing one or more mixing operations on samples associated with the polarity-sensitive audio input channels, where the one or more mixing operations are based on the polarity combination and produce a candidate audio mix that is associated with the polarity combination; calculating a value of a signal characteristic associated with the candidate audio mix; and applying an optimization criterion to the values of the signal characteristic calculated for each of the polarity combinations to select a final audio mix.

Further embodiments provide, among other things, a system and a non-transitory computer-readable medium configured to implement the method set forth above.

At least one advantage of the disclosed techniques is that live mixing consoles may implement these techniques to efficiently produce audio mixes that optimize the listening experience for the audience. Notably, determining an optimal polarity combination based on candidate, unheard audio mixes generated in a concurrent and comprehensive fashion shields the audience from exposure to the multiple inferior mixes associated with typical ad-hoc, trial-and-error approaches to polarity optimization. Further, because the quality of each of the candidate audio mixes is calculated deterministically, the quality of the final audio mix is not unnecessarily dependent on the skill of a mixing engineer.

BRIEF DESCRIPTION OF THE DRAWINGS

So that the manner in which the above recited features of the various embodiments can be understood in detail, a more particular description, briefly summarized above, may be had by reference to embodiments, some of which are illustrated in the appended drawings. It is to be noted, however, that the appended drawings illustrate only typical embodiments and are therefore not to be considered limiting in scope, for the various embodiments may admit to other equally effective embodiments.

FIG. 3 illustrates how the internal mixer of FIG. 2 generates unheard sample mixes, according to various embodiments;

DETAILED DESCRIPTION

In the following description, numerous specific details are set forth to provide a more thorough understanding of the various embodiments. However, it will be apparent to one of skill in the art that the various embodiments may be practiced without one or more of these specific details.

Overview of Performance System

Figure 1:
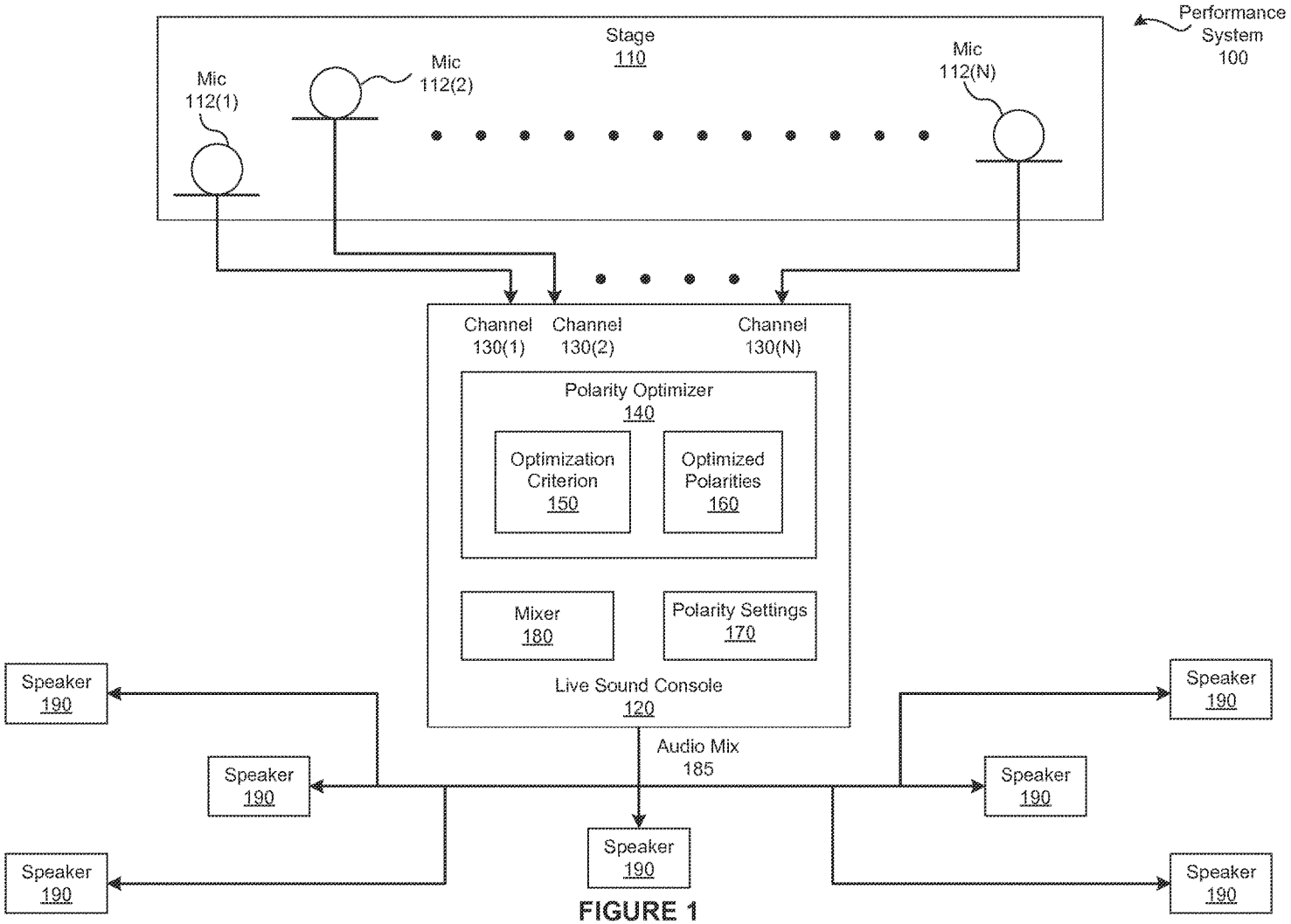
FIG. 1 illustrates a performance system configured to implement one or more aspects of the various embodiments.

FIG. 1 illustrates a performance system 100 configured to implement one or more aspects of the various embodiments. As shown, the performance system 100 includes, without limitation, a stage 110, a live sound console 120, and any number of speakers 190. For explanatory purposes, multiple instances of like objects are denoted with reference numbers identifying the object and parenthetical numbers identifying the instance where needed. Further, a range of like objects are denoted with a parenthetical range (i.e., (1:N)). In alternate embodiments, the performance system 100 may be implemented in other structures or locales and may include other types of audio equipment deployed and distributed in any technically feasible manner instead of or in addition to the stage 110, the live sound console 120, and the speakers 190. For example, in some embodiments and without limitation, the performance system 100 could be located in a recording studio that does not include a stage, could include an application executing on a digital audio workstation in lieu of a live sound console, and could include headphones instead of speakers.

Among other things, the stage 110 includes any number of microphones (mics) 112 that receive sounds generated on the stage 110 and then convert the sounds into audio microphone signals. Accordingly, the audio microphone signals may correspond to different sounds, such as bass guitar, vocalist, drums, etc., as perceived at different locations on the stage 110. As shown, the audio microphone signals are routed to the live sound console 120 as channels 130, also referred to herein as "audio input channels." The routing may be implemented in any technically feasible fashion, such as via audio cables, any type of wireless communication system, or the like. Although not shown, audio signals from any number and types of other sound sources may be routed to the live sound console 120 and included in the channels 130.

As shown, the live sound console 120 includes, without limitation, a mixer 180, polarity settings 170, and a polarity optimizer 140. In operation, the mixer 180 performs mixing operations on any number of the channels 130, including the channels 130 that receive signals from the microphones 112, and generates an audio mix 185 that includes one or more output electronic audio signals and is routed to the speakers 190. The polarity settings 170 are one of any number of selection mechanisms included in the live sound console 120 that configure the mixer 180 to generate the audio mix 185 that conveys desired performance characteristics. Ideally, the mixing engineer leverages the selection mechanisms, including the polarity settings 170, to dynamically generate the audio mix 185 that optimizes the listening experience for the audience.

For each of the channels 130(*i*), the value of the polarity setting 170(*i*) specifies a polarity of the channel 130(*i*). In operation, if the value of the polarity setting 170(*i*) is positive, then the mixer 180 does not alter the polarity of the channel 130(*i*). If, however, the value of the polarity setting 170(*i*) is negative, then the mixer 180 inverts the polarity of the channel 130(*i*)—altering the phase of the channel 130(*i*) by 180 degrees. The polarity settings 170 may configure the mixer 180 in any technically feasible fashion, and the mixer 180 may invert polarities using any methods as known in the art. For example, and without limitation, the mixer 180 may be a software application that is executed by a processor unit with an instruction set that includes a "negation" command. In such a scenario, to invert the polarity of the channel 130(*i*), the mixer 180 could apply the negation command to the samples (i.e. values at particular times) associated with the channel 130(*i*).

Optimizing the Polarities of Audio Input Channels

Each of the channels 130 may combine destructively or constructively with each of the other channels 130. Accordingly, the values of the polarity settings 170 may significantly impact the listening experience for the audience, especially at the lower frequencies where the effect of phase cancellation is particularly noticeable. Advantageously, in contrast to conventional trial-and-error approaches to optimizing the values of the polarity settings 170, the polarity optimizer 140 is configured to automatically and deterministically determine optimized polarities 160 based on an optimization criterion 150. In operation, the polarity optimizer 140 generates multiple polarity combinations and then applies these polarity combinations to samples associated with the channels 130 in a substantially concurrent manner to generate multiple, unheard sample mixes (i.e., output electronic audio signals that are not routed to the speakers 190). In particular, while determining the optimized polarities 160, the polarity optimizer 140 does not alter the values of the polarity settings 170. Consequently, since the mixer 180 continues to perform mixing operations as specified by the polarity settings 170, the relative composition of the listening experience transmitted via the audio mix 185 remains consistent for the audience and the mixing engineer.

Although the term "unheard" sample mixes is used herein, as part of performing the disclosed techniques, the polarity optimizer 140 may generate any type of "candidate" sample mixes in lieu of the unheard sample mixes. Such candidate sample mixes may be processed in any technically feasible fashion and may be routed, without limitation, to any number and combination of the speakers 190, headphones, audio devices, storage devices, etc. For example, in some embodiments and without limitation, the performance system 100 could be located in a recording studio and the sound engineer could audition the candidate sample mixes via the headphones as the polarity optimizer 140 determines the optimized polarities 160.

The polarity optimizer 140 may be implemented in any technically feasible fashion, configured to execute any number of times, and may be invoked in any pre-determined manner. For example, and without limitation, in some embodiments the polarity optimizer 140 may be a software application, may execute on a processing unit as a background process, and may run continually in response to receiving samples associated with the channels 130. In some such embodiments, without limitation, the polarity optimizer 140 may suspend analysis operations between songs, or if all the input levels are below a specified threshold. In other embodiments, without limitation, the polarity optimizer 140 may be included in a digital audio workstation, may be configured to execute once upon invocation, and may be invoked via a "polarity analysis" button included in the digital audio workstation.

In some embodiments, after the polarity optimizer 140 determines the optimized polarities 160, the polarity optimizer 140 may automatically update the values of the polarity settings 170—improving the audio mix 185 and the corresponding listening experience for the user. In other embodiments, after the polarity optimizer 140 determines the optimized polarities 160, the polarity optimizer 140 may communicate the availability and/or the optimized polarities 160 in any technically feasible fashion. Such embodiments may provide any number of mechanisms that enable the mixing engineer to update the values of the polarity settings 170 based on the optimized polarities 160. For example, and without limitation, in some embodiments, after the polarity optimizer 140 determines the optimized polarities 160, the polarity optimizer 140 configures a user widget to indicate that the optimized polarities 160 are available and to enable the mixing engineer to "apply" the optimized polarities 160. The widget may be any type of communication mechanisms, such as, and without limitation, one or more light-emitting diodes (LEDs), a pop-up window, or the like. In other embodiments, without limitation, after the polarity optimizer 140 determines the optimized polarities 160, the polarity optimizer 140 highlights the channels 130 that are optimally associated with negative polarities. For example, and without limitation, based on the optimized polarities 160, the polarity optimizer 140 could selectively illuminate LEDs that are associated with per-channel polarity inversion selection buttons included in the live mixing console 120.

To remove the unpredictability inherent in subjective metrics, the optimization criterion 150 specifies a deterministic basis for assessing whether one combination of values of the polarity settings 170 is preferable to another combination of values of the polarity settings 170. In general, the optimization criterion 150 specifies a goal for a signal characteristic. For example, and without limitation, the optimization criterion 150 may reflect one of the following, mutually exclusive, goals:

1. Maximize the root mean square (RMS) energy in the audio mix 185
2. Match a spectral target (i.e., minimize the depth of dips and notches in the spectrum) of the audio mix 185
3. Minimize the crest factor (i.e., the peak) of the audio mix 185
4. Maximize the crest factor of the audio mix 185.

In operation, for each of the unheard sample mixes, the polarity optimizer 140 is configured to calculate the value of the signal characteristic included in the optimization criterion 150. Subsequently, the polarity optimizer 140 compares the values of the signal characteristic to identify the best of the unheard sample mixes according to the goal of the optimization criterion 150. The polarity optimizer 140 then sets the optimized polarities 160 to reflect the polarities included in the best unheard sample mix. The polarity optimizer 140 may calculate and compare the values of the signal characteristic in any technically feasible and deterministic fashion. For example, and without limitation, the polarity optimizer 140 could perform any number signal analysis and comparison operations, such as minimization operations, maximization operations, summation operations, fast Fourier transforms, magnitude operations, and the like.

Figure 2:
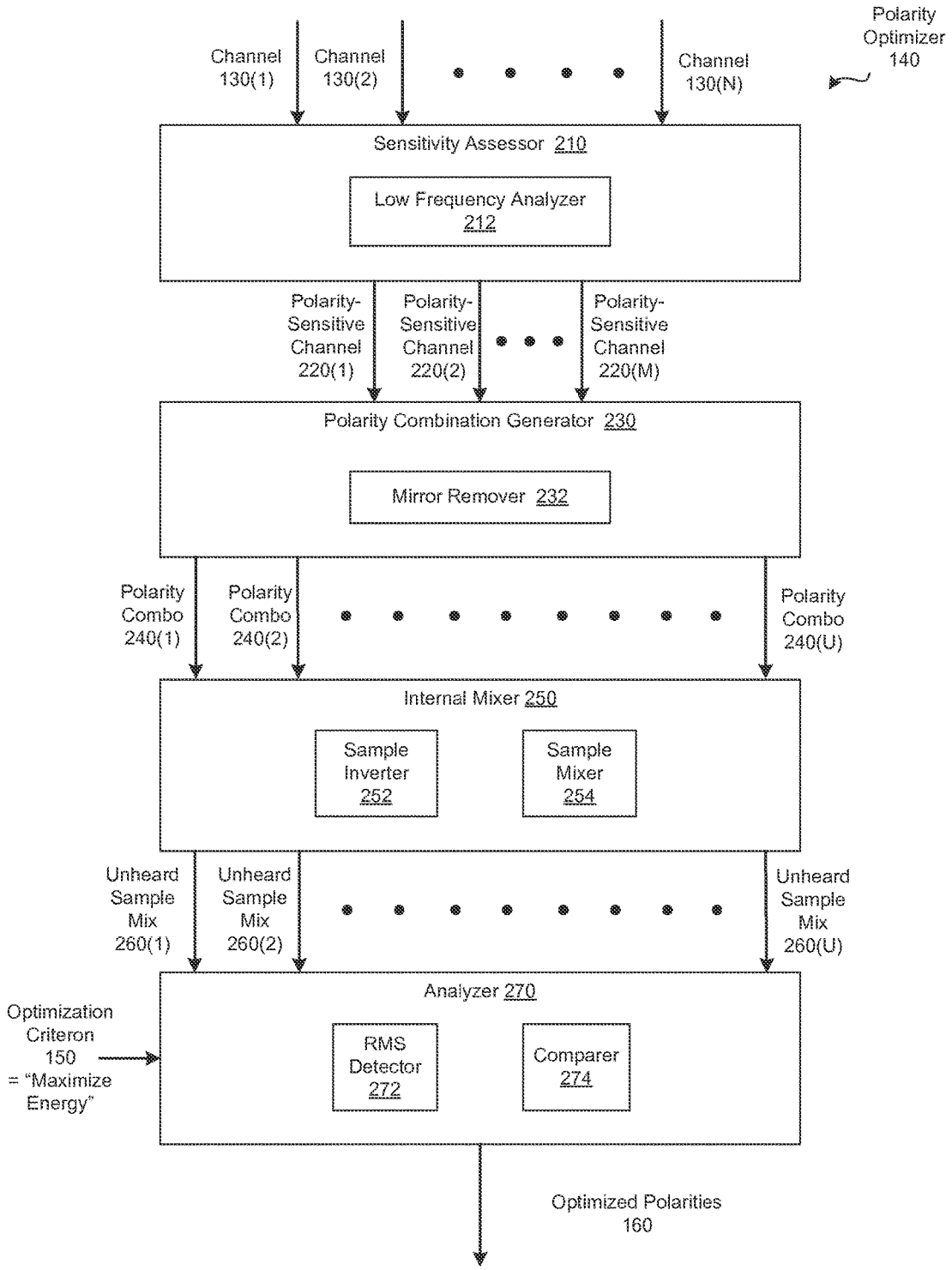
FIG. 2 is a more detailed illustration of the polarity optimizer of FIG. 1, according to various embodiments.

FIG. 2 is a more detailed illustration of the polarity optimizer 140 of FIG. 1, according to various embodiments. As shown, the polarity optimizer 140 includes, without limitation, a sensitivity assessor 210, a polarity combination generator 230, an internal mixer 250, and an analyzer 270. In alternate embodiments, without limitation, any number of units may provide the functionality included in the polarity optimizer 140 and each of the units may be implemented in software, hardware, or any combination of software and hardware.

The sensitivity assessor 210 includes, without limitation, a low frequency analyzer 212. In general, the polarities of relatively high frequency pitched sounds (i.e., sounds that do not include relatively low frequency components) are unlikely to significantly impact the listening experience for the audience. Consequently, the sensitivity assessor 210 is configured to exclude relatively high-frequency pitches from subsequent polarity analysis operations. In operation, upon receiving samples associated with the channels 130(1:N), the low frequency analyzer 212 performs one or more signal processing operations to identify channels that include components with frequencies below a pre-configured lower threshold. The sensitivity assessor 210 then relays the subset of the channels 130(1:N) that include the identified components as polarity-sensitive channels 220(1:M), where M<=N, to the polarity combination generator 230 for polarity analysis purposes. The low frequency analyzer 212 may be configured to implement any lower threshold below which the impact of revered polarities is considered significant.

In alternate embodiments, the sensitivity assessor 210 may perform any number of additional operations designed to reduce the complexity of subsequent polarity analysis operations in any technically feasible fashion. For example, and without limitation, the sensitivity assessor 210 could "test" each of the samples to determine whether inverting the polarity of the sample varies the root mean square (RMS) energy in the mix. In other embodiments, the sensitivity assessor 210 may be configured to accept "disregard channel" user requests via a user interface widget, allowing the mixing engineer to exclude any number of the channels 130 from further polarity analysis operations. In yet other embodiments, the sensitivity assessor 210 may perform one or more correlation operations to determine whether any of the channels 220 may be grouped together (i.e., fixing the polarity of the channel 220(*i*) relative to the polarity of the channel 220(*j*)) without noticeably affecting the listening experience for the user.

Upon receiving the polarity-sensitive channels 220, the polarity combination generator 230 performs a variety of permutation operations to generate polarity combinations (polarity combos) 240. The polarity combination generator 230 may generate the polarity combinations 240 in any technically fashion. For example, and without limitation, the polarity combination generator 230 could exhaustively enumerate all permutations of the values of the polarity settings 170 for all the polarity-sensitive channels 220 in a brute-force manner.

As shown, the polarity combination generator 230 includes, without limitation, a mirror remover 232. Notably, as persons skilled in the art will recognize, inverting the polarity of all components included in a mix of the components, referred to herein as "mirroring," does not affect the nature/quality of the listening experience provided by the mix of the components. The mirror remover 232 leverages this characteristic of mirrored combinations to exclude almost half of the polarity combinations 240.

For explanatory purposes, the polarity-sensitive channel 220(1) is referred to herein as "A," the polarity-sensitive channel 220(2) is referred to herein as "B", and so forth. Further, the polarity of a sample associated with the polarity-sensitive channel 220(1) "A" is referred to herein as the positive polarity and the sample is indicated as "+A." The polarity of an inverted sample (i.e., the negative of a sample) associated with the polarity-sensitive channel 220(1) "A" is referred to herein as the negative polarity and the inverted sample is indicated as "−A." Additional polarity-sensitive channels 220(2:N) (e.g., "B," etc.) are referenced following the same nomenclature as the polarity-sensitive channel 220(1) "A."

In general, the mirror remover 232 may implement any number of operations and employs any number of algorithms to properly prune the polarity combinations 240. For example, and without limitation, suppose that M (the number of the polarity-sensitive channels) were 2. In such a scenario, the polarity combination generator 230 could initially produce four polarity combinations 240: +A+B, +A−B, −A+B, and −A−B. Subsequently, the mirror remover 232 could eliminate −A+B as a mirror of +A−B and −A−B as a mirror of +A+B, thereby optimizing the polarity combinations 240 to include only +A+B and +A−B. In some embodiments, without limitation, the mirror remover 232 may be configured to ensure that there are never more negative values than positive values included in each of the polarity combinations 240. For example, and without limitation, if +A−B−C and −A−B+C were both initially included in the polarity combinations 240, then the mirror remover 232 could eliminate −A−B+C from the polarity combinations 240.

Typically, after the mirror remover 232 optimizes the polarity combinations 240, the number of polarity combinations 240 (shown in FIG. 2 as "U") for the polarity-sensitive channels 220(1:M) is 2^(M−1). In alternate embodiments, the polarity combination generator 230 may or may not include the mirror remover 232 and may implement any number of complexity-reducing heuristics in addition to or instead of eliminating mirrors from the polarity combinations 240.

The internal mixer 250 includes, without limitation, a sample inverter 252 and a sample mixer 254 that work together to produce unheard sample mixes 260(1:U). For example, and without limitation, if the internal mixer 250 were to receive the polarity combinations 240(1:32), then the sample inverter 252 and the sample mixer 254 would collaboratively produce the unheard sample mixes 260(1:32). First, the sample inverter 242 calculates the negative of each of the samples associated with the polarity-sensitive channels 220, thereby generating corresponding inverted samples. The sample mixer 254 then combines the samples and the inverted samples based on the polarity combinations 240 to generate the unheard sample mixes 260. For example and without limitation, the polarity combination 240(*x*) could include a positive polarity for the polarity-sensitive channel 220(*i*) and a negative polarity for the polarity-sensitive channel 220(*j*). Based on the polarity combination 240(*x*), the internal mixer 250 would include the sample associated with the polarity-sensitive channel 220(*i*) and an inverted sample associated with the polarity-sensitive channel 220(*j*) in the unheard sample mix 260(*x*).

Notably, because the sample inverter 242 provides the inverted samples, the sample mixer 254 does not repeatedly and unnecessarily perform inversion operations as part of generating each of the unheard sample mixes 260. Consequently, the overall number of computational operations that the internal mixer 250 performs is reduced compared to a brute-force mixing approach that does not pre-calculate the inverted samples. In some embodiments, to further reduce the overall computation load, the internal mixer 250 is configured to implement combinatorics-based algorithms. For example, and without limitation, in some embodiments the internal mixer 250 may be configured to implement the combinatorics-based calculations described below in FIG. 3.

Advantageously, the internal mixer 250 generates the unheard sample mixes 260 substantially in parallel. By contrast, in trial-and-error approaches, the mixing engineer (and the audience) auditions one audio mix and then another audio mix in a sequential manner that may conflate variations in the values of the polarity settings 170 with temporal variations in the samples associated with the channels 130. Such conflation may negatively impact the equability of the trial-and-error comparisons and, therefore, may lead to an inferior selection of values of the polarity settings 170. In alternate embodiments, the internal mixer 250 may include any number of components in addition to or instead of the sample inverter 242 and the sample mixer 254 that, together, produce the unheard sample mixes 260 in a substantially concurrent manner.

The analyzer 270 includes, without limitation, a root mean square (RMS) detector 272 and a comparer 274. The analyzer 270 receives the unheard sample mixes 260 and an optimization criterion 150 and produces the optimized polarities 160. The optimization criterion 150 is a configurable parameter that customizes the analysis and comparison operations that the analyzer 270 performs. The analyzer 270 may receive the optimization criterion 150 in any technically feasible fashion, such as via a user widget included in the live sound console 120. The optimization criterion 150 may specify any relevant optimization metric in any fashion as known in the art. In alternate embodiments, the analyzer 270 may be designed to implement a single, predetermined optimization criterion 150. Further, the analyzer 270 may or may not include the RMS detector 272 and/or the comparer 274, and may implement any number of algorithms included in any number of components to evaluate the unheard sample mixes 260 with respect to the optimization criterion 150.

As shown, the optimization criterion 150 is set to "maximize energy." Consequently, the analyzer 270 is configured to determine the optimized polarities 160 that, if applied to the samples associated with the channels 130 via the polarity settings 170, would maximize the energy in the audio mix 185. In operation, the RMS detector 270 is configured to calculate the values of the energy in each of the unheard sample mixes 260. Subsequently, the comparer 274 selects the maximum value of the energy and the corresponding unheard sample mix 260. The analyzer 270 then sets the optimized polarities 160 based on the polarities of the samples included in the selected unheard sample mix 260. For example, and without limitation, if the energy in the unheard sample mix 260(U) were greater than the energy in each of the unheard sample mixes 260(1:U−1), then the analyzer 270 would set the optimized polarities 260 based on the polarities of the samples included in the polarity combination 240(U).

In general, the analyzer 270 may be configured to perform any type of deterministic signal analysis and comparison operations to ascertain which of the unheard sample mixes 260 would provide the optimal listening experience. Further, the analyzer 270 may be configured to calculate the values of the signal characteristic and compare the values using any number of components that are implemented in any combination of software and hardware.

In alternate embodiments, the functionality included in the polarity optimizer 140 may be distributed between any number and types of components. For example, and without limitation, the combination generator 230 and the internal mixer 250 may be combined into a single component. Further, each of the components included in the polarity optimizer 140 may be implemented in any technically feasible fashion using any combination of software, firmware, and hardware. For example, and without limitation, in an entirely software implementation, the polarity optimizer 140 could be an application executed by a laptop. In yet other embodiments, the functionality included in the polarity optimizer 140 may be modified to reflect any number of analysis operations designed to determine the optimal polarities of the channels 130 to include in the audio mix 185.

FIG. 3 illustrates how the internal mixer 250 of FIG. 2 generates the unheard sample mixes 260, according to various embodiments. In general, to reduce the time required to produce the unheard sample mixes 260, the internal mixer 250 implements combinatorics-based algorithms. More specifically, instead of generating each of the unheard sample mixes 260 as a direct combination of individual samples and inverted samples, the internal mixer 250 generates each of the unheard sample mixes 260 as an indirect combination of sample mixes. A "combinatorics-based unheard sample mixing of four channels" 310 and a "combinatorics-based unheard sample mixing of sixteen channels" 350 illustrate the indirect mixing performed by the internal mixer 250 to efficiently generate the unheard sample mixes 260. In the context of FIG. 3, prior to the operations illustrated in the combinatorics-based unheard sample mixing of four channels" 310 and the "combinatorics-based unheard sample mixing of sixteen channels" 350, the sample inverter 252 calculates the negative of each of the samples to provide corresponding inverted samples.

The "combinatorics-based unheard sample mixing of four channels" 310 depicts the indirect mixing that the sample mixer 254 performs to generate the unheard sample mixes 260(1:16) of the polarity-sensitive channels 220(1:4) (labelled A, B, C, and D) based on the polarity combinations 240(1:16). First, the sample mixer 254 performs pairwise mixing, combining A and B to form four pair mixes: +A+B, +A−B, −A+B, and −A−B and combining C and D to form four additional pair mixes +C+D, +C−D, −C+D, and −C−D. Subsequently, the sample mixer 254 combines these pair mixes to create sixteen quadruplet mixes—the unheard sample mixes 260(1:16) corresponding to the polarity combinations 240(1:16).

Accordingly, the internal mixer 250 performs twenty-four addition operations to create the unheard sample mixes 260(1:16) of the polarity-sensitive channels 220(1:4)—four addition operations to create the AB pair mixes, four addition operations to create the CD pair mixes, and sixteen addition operations to create the sixteen unheard sample mixes 260. By contrast, a brute-force method that generates the unheard sample mixes 260(1:16) based directly on samples and inverted samples requires forty-eight addition operations.

The "combinatorics-based unheard sample mixing of sixteen channels" 350 depicts the indirect mixing that the sample mixer 254 performs to generate the unheard sample mixes 260 of the polarity-sensitive channels 220(1:16) (labelled A through P) based on the polarity combinations 240(1:65,536). First, the sample mixer 254 performs pairwise mixing, combining A and B to form four pair mixes, C and D to form four additional pair mixes, E and F to form four additional pair mixes, and so forth. Consequently, the sample mixer 254 performs 32 addition operations to create the pair mixes. The sample mixer 254 then combines these pair mixes, combining the AB mixes and the CD mixes to form sixteen quadruplet mixes, the EF mixes and the GH mixes to form sixteen additional quadruplet mixes, etc. In this fashion, the sample mixer 254 performs 64 addition operations to create the quadruplet mixes based on the pair mixes.

The sample mixer 254 then combines these quadruplet mixes, combining the ABCD mixes and the EFGH mixes to form 256 16-tuple mixes, and the IJKL mixes and the MNOP mixes to form another 256 16-tuple mixes. Consequently, the sample mixer 254 performs 512 addition operations to create the 16-tuple mixes based on the quadruplet mixes. Finally, the sample mixer 254 combines these 16-tuple mixes, performing 65,536 addition operations to combine the ABCDEFGH mixes and the IJKLMNOP mixes to form the unheard sample mixes 260(1:65,536). Notably, the sample mixer 254 performs a total of 66,144 addition operations to produce the unheard sample mixes 260(1:65,536). By contrast, a brute-force method that generates the unheard sample mixes 260(1:65,536) based directly on samples and inverted samples would require 524,288 addition operations−458,752 more addition operations than performed by the sample mixer 254.

In some embodiments, without limitation, the polarity optimizer 140 includes the mirror remover 232 in addition to implementing combinatorics-based algorithms. In such embodiments, the number of addition operations may be further reduced. For example, and without limitation, in such embodiments the mirror remover 232 could reduce the initial polarity combinations 240(1:65,536) of the polarity-sensitive channels 220(1:16) to the polarity combinations 240(1:32,768). Subsequently, the sample mixer 254 could perform 32,906 addition operations to generate the unheard sample mixes 260(1:32,768) of the polarity-sensitive channels 220(1:16) as per the polarity combinations 240(1:32,768).

Figure 4:
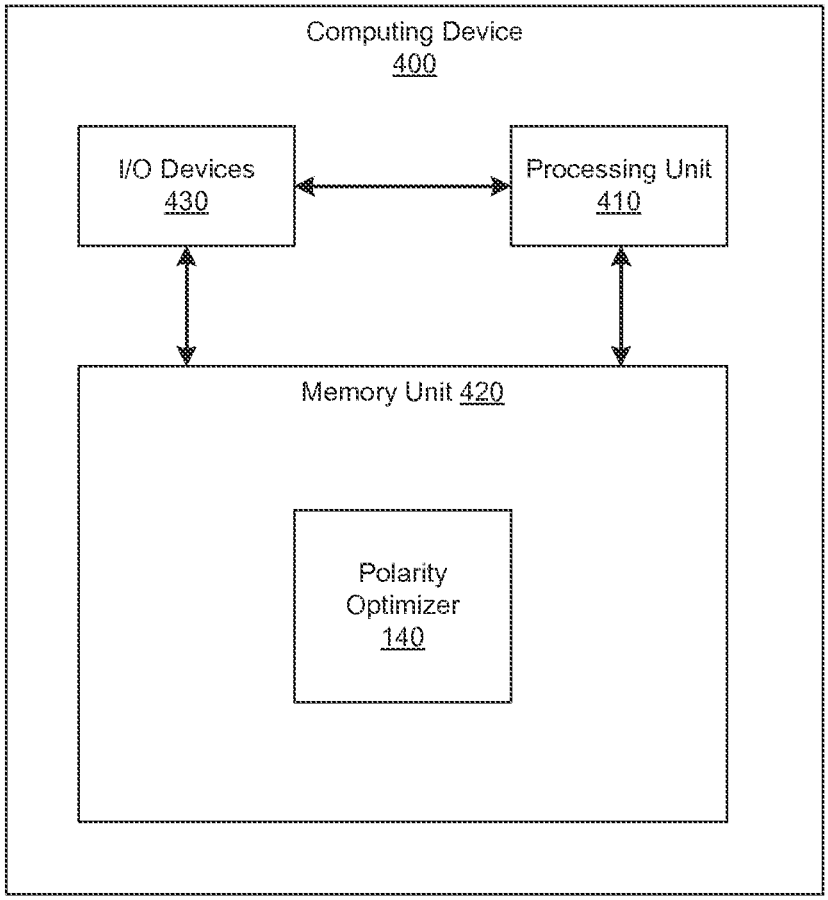
FIG. 4 illustrates a computing device within which one or more aspects of the polarity optimizer of FIG. 1 may be implemented, according to various embodiments.

FIG. 4 illustrates a computing device 400 within which one or more aspects of the polarity optimizer 140 of FIG. 1 may be implemented, according to various embodiments. The computing device 400 may be any type of device capable of executing application programs including, and without limitation, application programs included in the polarity optimizer 140. For example, and without limitation, the computing device 400 may be configured to execute any number and combination of the sensitivity assessor 210, the polarity combination generator 230, the internal mixer 250, and the analyzer 270. As shown, the computing device 400 includes, without limitation, a processing unit 410, a memory unit 420, and input/output (I/O) devices 430.

The processing unit 410 may be implemented as a central processing unit (CPU), digital signal processing unit (DSP), graphics processor unit (GPU), and so forth. Among other things, and without limitation, the processing unit 410 executes one or more application programs that implement the polarity optimizer 140 and are stored in the memory unit 420 and/or external memory accessible by the processing unit 410, such as a Secure Digital Card, external Flash memory, a portable compact disc read-only memory (CD-ROM), an optical storage device, a magnetic storage device, or any suitable combination of the foregoing.

The memory unit 420 may include a memory module or collection of memory modules that provide storage space accessible by the processing unit 410. In some embodiments, without limitation, any number and combination of the sensitivity assessor 210, the polarity combination generator 230, the internal mixer 250, and the analyzer 270 may be stored in the memory unit 240. The I/O devices 430 may include input devices, output devices, and devices capable of both receiving input and providing output and may enable any communication protocols. For example, and without limitation, the I/O devices 430 may include Smart WiFi and Bluetooth interfaces.

In alternate embodiments, the computing device 400 may be replaced and/or supplemented with any number of signal processing components that facilitate the operation of the live sound console 120. For example, and without limitation, instead of the computing device 400, the live sound console 120 may include components that implement a variety of filters, digital to analog converters, dynamic amplifiers, etc. that are configured to implement the functionality included in the polarity optimizer 140. In yet other alternate embodiments, the live sound console 120 may be replaced with any type of audio equipment that is configured to implement the functionality included in the polarity optimizer 140. For example, and without limitation, the live sound console 120 could be replaced by a digital audio workstation in a recording studio and the "audience" could be replaced by a stereo audio file.

In general, and without limitation, the computing device 400 may be implemented as a stand-alone chip or as part of a more comprehensive solution that is implemented as an application-specific integrated circuit (ASIC), a system-on-a-chip (SoC), and so forth. Further, the computing device 400 may be incorporated into the live sound console 120 of FIG. 1 in any technically feasible fashion and as any number of discrete or integrated units. For example, and without limitation, each of the processing unit 410, the memory unit 420, and the I/O devices 430 may be embedded in or mounted on a laptop, a tablet, a smartphone, or the like that implements the live sound console 120. In general, the embodiments disclosed herein contemplate any technically feasible system configured to implement the functionality included in various components of the polarity optimizer 140 in any combination.

Figure 5:
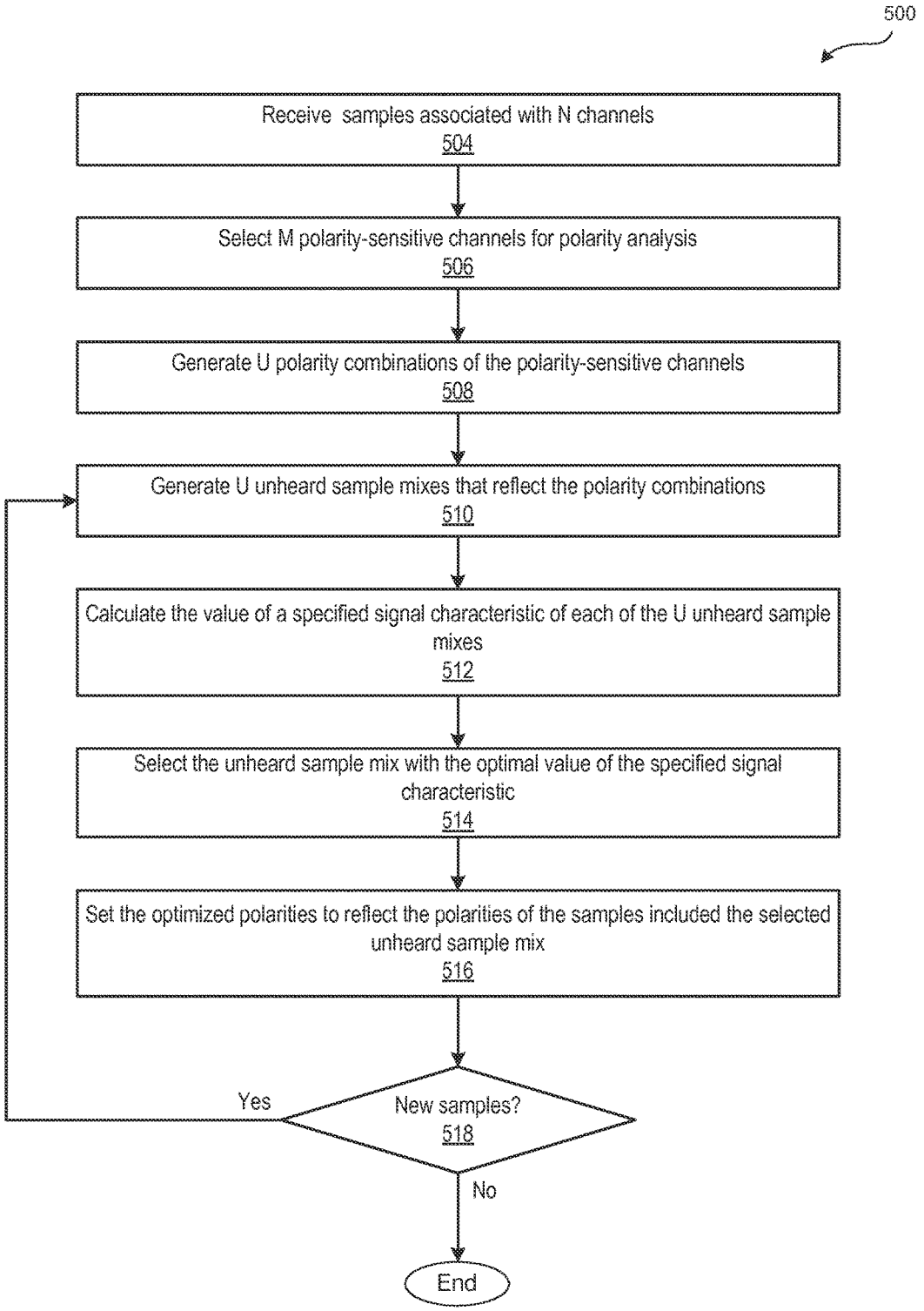
FIG. 5 is a flow diagram of method steps for selecting the polarities of audio input channels when generating an audio mix, according to various embodiments.

FIG. 5 is a flow diagram of method steps for selecting the polarities of audio input channels when generating an audio mix, according to various embodiments. Although the method steps are described in conjunction with the systems of FIGS. 1-4, persons skilled in the art will understand that any system configured to implement the method steps, in any order, falls within the scope of the various embodiments.

As shown, a method 500 begins at step 504, where the polarity optimizer 140 receives samples associated with the channels 130(1:N). The polarity optimizer 140 may receive the samples associated with the channels 130 in any technically feasible fashion and from any sound sources, including the microphones 112. For example, and without limitation, the live sound console 120 could include wireless receivers that receive transmissions from the microphones 112 as the channels 130, and the live sound console 120 could then relay the channels 130 to the polarity optimizer 140.

At step 506, the sensitivity assessor 210 evaluates the channels 130(1:N) to identify the polarity-sensitive channels 220(1:M), where M<=N. In general, to increase the overall efficiency of the polarity optimizer 140, the sensitivity assessor 210 identifies and exploits opportunities to reduce the number of the polarity combinations 240 that the polarity optimizer 140 considers to determine the optimized polarities 160. For example, and without limitation, in some embodiments, the sensitivity assessor 210 performs any number of operations that identify a subset of the channels 130 that are relatively sensitive to polarity inversions. The sensitivity assessor 210 then relays the identified channels as the polarity-sensitive channels 220 to the polarity combination generator 230, and effectively suppresses the channels 130 that are not identified. Advantageously, for each of the channels 120 that the sensitivity assessor 210 excludes from the polarity-sensitive channels 220, the number of polarity combinations 240 that the polarity combinations generator 230 produces for polarity analysis is nearly halved.

At step 508, the polarity combination generator 230 receives the polarity-sensitive channels 220(1:M) and generates the polarity combinations 240(1:U). The polarity combination generator 230 may generate the polarity combinations 240 in any technically fashion. For example, and without limitation, the polarity combination generator 230 could exhaustively enumerate all permutations of the polarities of the polarity-sensitive channels 220 in a brute-force manner. In some embodiments, to reduce the number of polarity combinations 240, the mirror remover 232 included in the polarity combination generator 230 prunes redundant "mirrored" combinations. In general, after the mirror remover 232 optimizes the polarity combinations 240, the number of the polarity combinations 240 is 2^(M−1), where M is the number of the polarity-sensitive channels 220.

At step 510, the internal mixer 250 generates the unheard sample mixes 260 that reflect the polarity combinations 240 of the samples of the polarity-sensitive channels 220. For example and without limitation, the polarity combination 240(*x*) could include a positive polarity for the polarity-sensitive channel 220(*i*) and a negative polarity for the polarity-sensitive channel 220(*j*). Based on the polarity combination 240(*x*), the internal mixer 250 would include the sample of the polarity-sensitive channel 220(*i*) and an inverted sample of the polarity-sensitive channel 220(*j*) in the unheard sample mix 260(*x*).

In some embodiments, without limitation, the internal mixer 250 may generate the unheard sample mixes 260 in a brute-force, isolated, manner—performing inversion and summation operations for each of the unheard sample mixes 260 based on the corresponding polarity combination 240. In other embodiments, without limitation, the internal mixer 250 may implement any number of algorithms to systematically reduce the number of the calculations required to generate the unheard sample mixes 260. For example, and without limitation, the internal mixer 250 could decrease the number of operations required to generate the unheard sample mixes 260 based on combinatorics.

At step 512, for each of the unheard sample mixes 260, the analyzer 270 calculates the value of one or more signal characteristics that are relevant to the optimization criterion 150. For example, and without limitation, the optimization criterion 150 could be "maximize energy" and the analyzer 270 could calculate the energy in each of the unheard sample mixes 260. At step 514, based on the optimization criterion 150, the comparer 274 performs one or more comparison operations between the values of the signal characteristic and, subsequently, selects the unheard sample mix 260(*i*)

with the optimal value for the signal characteristic. In some embodiments, because the polarity optimizer 140 is configured to sagaciously reduce the number of polarity combinations 240 that the polarity combinations generator 230 produces for polarity analysis, typically time consuming comparison operations performed by the comparer 274 may be optimized. At step 516, the analyzer 270 sets the optimized polarities 160 to reflect the polarity combination 240(*i*) that is associated with the selected unheard sample mix 260(*i*).

In general, the analyzer 270 may be configured to perform any type of deterministic signal analysis and comparison operations to ascertain which of the unheard sample mixes 260 would provide, if heard by the audience, the optimal listening experience. Further, the analyzer 270 may be configured to calculate the values of the signal characteristic and compare the values using any number of components that are implemented in any combination of software and hardware. For example, and without limitation, the analyzer 270 could include the RMS detector 272 implemented in hardware and the comparer 274 implemented in software.

At step 518, the polarity optimizer 140 determines whether new samples (i.e., samples for a different point in time) are associated with the channels 130. Notably, at any particular time, the polarity optimizer 140 processes samples that correspond to that particular time. To support execution in real-time, the polarity optimizer 140 is configured to process the samples at the sampling frequency. For example, and without limitation, if the live sound console 120 were to implement 48 kilohertz (kHz) sampling, then the polarity optimizer 140 would process (i.e., perform the method 500) 48,000 sets of samples associated with the channels 130 each second. In alternate embodiments, the live sound console 120 may be replaced with any type of off-line audio equipment that includes the functionality of the polarity optimizer 140 and the mixer 180. In such embodiments, the polarity optimizer 140 may be configured to process the samples at any rate, including a rate that is slower than the sampling rate.

If, at step 518, the polarity optimizer 140 determines that there are new samples associated with the channels 130, then the method 500 returns to step 510 where the polarity optimizer 140 processes these new samples and updates the optimized polarities 160, thereby tracking any changes in the optimal audio mix over time. If, however, at step 518, the polarity optimizer 140 determines that there are no new samples associated with the channels 130, then the method 500 terminates. The lack of new samples may be indicative of a variety of conditions including, without limitation, the end of a song or the end of a performance. In various embodiments, the polarity optimizer 140 may be configured to re-execute any number of the steps included in the method 500 based on any number and type of stimulus, such as user input, receiving samples for the next song, and the like.

In one embodiment, a polarity optimizer determines optimal polarities of audio input channels during a performance. In operation, the polarity optimizer generates a set of polarity combinations, where each polarity combination specifies a different permutation of positive and negative polarities of the audio input channels. As part of generating the polarity combinations, the polarity optimizer identifies and exploits opportunities to reduce the number of relevant combinations. For example, and without limitation, after identifying one or more audio input channels that are relatively insensitive to polarity changes, the polarity optimizer eliminates the polarities of the identified audio input channels from further analysis. For each of the polarity combinations, the polarity optimizer processes samples of the audio input channels to generate unheard sample mixes—audio mixes that are intended for analysis and are not routed to sound generation devices, such as speakers, earphones, etc.

More specifically, for each audio input channel, the polarity optimizer receives a sample and then generates an inverted (i.e., negative polarity) sample. Subsequently, the polarity optimizer combines inverted samples and/or non-inverted samples of the audio input channels as per each of the polarity combinations to generate corresponding unheard sample mixes. To efficiently produce various unheard sample mixes, the polarity optimizer implements a combinatorics-based approach. The polarity optimizer then calculates the root mean square (RMS) energy in each of the unheard sample mixes and selects the polarity combination that is associated with the unheard sample mix with the maximum RMS energy. For each of the audio input channels, the polarity optimizer sets the optimal polarity to reflect the corresponding polarity included in the selected polarity combination. The polarity optimizer continues in this fashion—generating unheard sample mixes based on the polarity combinations and samples of the audio input channels at different points in time—until the performance is finished.

At least one advantage of the disclosed approach is that the process of determining the optimal polarities of the audio input signals does not negatively impact the listening experience for the audience. More specifically, unlike conventional trial-and-error approaches to optimizing the polarities, the audience is not exposed to numerous audio mixes corresponding to non-optimal polarity combinations. Advantageously, because the polarity optimizer automatically and concurrently generates the audio mixes, the polarity optimizer comprehensively and equitably evaluates the relevant polarity combinations. By contrast, substantially manual, sequential approaches to determining ostensible optimal polarities are prohibitively time consuming and, consequently, a comprehensive trial-and-error analysis is impractical. Further, because the optimization criterion (e.g., maxing the RMS energy in the audio mix) is amenable to deterministic evaluation and comparison, selecting the optimal polarity combination is not dependent upon the subjective judgement of mixing engineers that can lead to poor polarity choices in conventional trial-and-error approaches.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The various embodiments have been described above with reference to specific embodiments. Persons of ordinary skill in the art, however, will understand that various modifications and changes may be made thereto without departing from the broader spirit and scope of the various embodiments as set forth in the appended claims. For example, and without limitation, although many of the descriptions herein refer to specific types of audiovisual equipment and sensors, persons skilled in the art will appreciate that the systems and techniques described herein are applicable to other types of performance output devices (e.g., lasers, fog machines, etc.) and sensors. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A method for selecting the polarities for a plurality of audio input channels when generating an audio mix, the method comprising:

generating a plurality of polarity combinations, wherein each polarity combination is associated with each polarity-sensitive audio input channel included in the plurality of audio input channels;

for each polarity combination included in the plurality of polarity combinations:

performing one or more mixing operations on samples associated with the polarity-sensitive audio input channels, wherein the one or more mixing operations are based on the polarity combination and produce a candidate audio mix that is associated with the polarity combination; and calculating a value of a signal characteristic associated with the candidate audio mix; and applying an optimization criterion to the values of the signal characteristic calculated for each of the polarity combinations to select a final audio mix; wherein the signal characteristic comprises a target spectrum, and applying the optimization criterion comprises performing one or more comparison operations between the values of a spectrum calculated for each of the plurality combinations to determine the similarity to the target spectrum.

2. The method of claim 1, wherein a first polarity associated with a first polarity combination included in the plurality of polarity combinations indicates a negative polarity, and performing the one or more mixing operations comprises generating a first inverted sample based on a first sample associated with a first audio input channel included in the plurality of audio input channels.

3. The method of claim 2, wherein performing the one or more mixing operations comprises combining the first inverted sample and at least a second sample that is associated with a second audio input channel included in the plurality of audio input channels.

4. The method of claim 1, wherein performing the one or more mixing operations comprises performing one or more combinatorics-based pairing operations on the samples associated with the polarity-sensitive audio input channels.

5. The method of claim 1, further comprising setting a final polarity combination to reflect the polarities of the samples included in the final audio mix.

6. A non-transitory, computer-readable storage medium including instructions that, when executed by a processor, configure the processor to select the polarities for a plurality of audio input channels when generating an audio mix, by performing the steps of:

generating a plurality of polarity combinations, wherein each polarity combination is associated with each polarity-sensitive audio input channel included in the plurality of audio input channels;

for each polarity combination included in the plurality of polarity combinations:

performing one or more mixing operations on samples associated with the polarity-sensitive audio input channels, wherein the one or more mixing operations are based on the polarity combination and produce a candidate audio mix that is associated with the polarity combination; and calculating a value of a signal characteristic associated with the candidate audio mix;

applying an optimization criterion to the values of the signal characteristic calculated for each of the polarity combinations to select a final audio mix; and prior to generating the plurality of polarity combinations:

receiving the plurality of audio input channels;

determining that a first audio input channel included in the plurality of audio input signals is more sensitive to polarity changes than a second audio input channel included in the plurality of audio input signals; and designating the first audio input channel, but not the second audio input channel, as a polarity-sensitive audio input channel.

7. The non-transitory computer-readable storage medium of claim 6, wherein performing the one or more mixing operations comprises:

generating a first inverted sample based on a first sample associated with a first audio input channel included in the plurality of audio input channels; and combining the first inverted sample and at least a second sample that is associated with a second audio input channel included in the plurality of audio input channels.

8. The non-transitory computer-readable storage medium of claim 6, wherein generating the plurality of polarity combinations comprises:

generating a set of potential polarity combinations associated with the polarity-sensitive audio input channels;

identifying one or more redundant polarity combinations included in the set of potential polarity combinations; and removing the one or more redundant polarity combinations from the set of potential polarity combinations.

9. The non-transitory computer-readable storage medium of claim 6, wherein determining that the first audio input channel is more sensitive to polarity changes comprises performing at least one of a low frequency analysis operation and at least one correlation analysis operation on at least one of the first audio input channel and the second audio input channel.

10. The non-transitory computer-readable storage medium of claim 6, further comprising configuring a digital audio workstation to produce an audio mix based on the final polarity combination.

11. The non-transitory computer-readable storage medium of claim 6, further comprising dynamically configuring a mixing console to produce an audio mix based on the final polarity combination.

12. A performance system, comprising:

a polarity optimizer that is configured to:

generate a plurality of polarity combinations, wherein each polarity combination is associated with each polarity-sensitive audio input channel included in the plurality of audio input channels;

for each polarity combination included in the plurality of polarity combinations:

perform one or more mixing operations on samples associated with the polarity-sensitive audio input channels, wherein the one or more mixing operations are based on the polarity combination and produce a candidate audio mix that is associated with the polarity combination; and calculate a value of a signal characteristic associated with the candidate audio mix; and apply an optimization criterion to the values of the signal characteristic calculated for each of the polarity combinations to select a final audio mix; and set a final polarity combination to reflect the polarities of the samples included in the final audio mix; and a mixer that is coupled to the polarity optimizer and is configured to produce an audio mix based on the final polarity combination; wherein the signal characteristic comprises a signal energy, and applying the optimization criterion comprises performing one or more comparison operations between the values of the signal energy calculated for each of the polarity combinations to determine a maximum signal energy value.

13. The performance system of claim 12, wherein performing the one or more mixing operations comprises:

generating a first inverted sample based on a first sample associated with a first audio input channel included in the plurality of audio input channels; and combining the first inverted sample and at least a second sample that is associated with a second audio input channel included in the plurality of audio input channels.

14. The performance system of claim 12, wherein performing the one or more mixing operations comprises performing one or more combinatorics-based pairing operations on the samples associated with the polarity-sensitive audio input channels.

* * * * *